United States Patent [19]

Singerman

[11] 4,312,636

[45] Jan. 26, 1982

[54] NOVEL ANISOLE MIXTURE AND GASOLINE CONTAINING THE SAME

[75] Inventor: Gary M. Singerman, Monroeville, Pa.

[73] Assignee: The United States of America as represented by the United States Department of Energy, Washington, D.C.

[21] Appl. No.: 205,224

[22] Filed: Nov. 12, 1980

[51] Int. Cl.[3] ..... C10L 1/18

[52] U.S. Cl. ..... 44/53; 44/77

[58] Field of Search ..... 208/8 LE, 10, 8 R; 568/630; 44/53, 77

[56] References Cited

FOREIGN PATENT DOCUMENTS 600837 4/1948 United Kingdom .

OTHER PUBLICATIONS

European Patent Application Serial # 79302082.7, Published 4/16/80.

NACA-Wartime Report "Knock Limited Performance of Pure Hydrocarbons Blended with a Base Fuel in a Full Scale Aircraft-Engine Cylinder; III-Four Aromatics, Six Ethers"; Mar. 1946.

*Primary Examiner*—Jacqueline V. Howard

*Attorney, Agent, or Firm*—Deane E. Keith; Forrest D. Stine; Joseph J. Carducci

[57] ABSTRACT

A novel anisole mixture containing anisole and a mixture of alkyl anisoles and liquid hydrocarbon fuels containing said novel anisole mixture in an amount sufficient to increase the octane number of said liquid fuel composition.

24 Claims, No Drawings

NOVEL ANISOLE MIXTURE AND GASOLINE CONTAINING THE SAME

The government of the United States of America has rights in this invention pursuant to contract No. DE-ACO1-79CS50022 awarded by the U.S. Department of Energy to Gulf Research & Development Company, a subsidiary of Gulf Oil Corporation.

BACKGROUND OF THE INVENTION

1. Field of the Invention

This invention relates to a novel anisole mixture containing anisole and a mixture of alkyl anisoles and a liquid fuel composition containing said novel anisole mixture in an amount sufficient to increase the octane number of said liquid fuel composition. The Government of the United States of America has rights in this invention pursuant to contract No. DE-ACO1-79CS50022 awarded by the U.S. Department of Energy to Gulf Research & Development Company, a subsidiary of Gulf Oil Corporation.

2. Description of the Prior Art

It is well known that liquid fuel compositions, particularly liquid hydrocarbon fuel compositions for spark ignition internal combustion engines, contain additives for the purpose of increasing the octane number of said liquid fuel compositions. For a long time tetraethyl lead has been the additive of choice. However, because of the environmental problems associated with the use of tetraethyl lead in liquid hydrocarbon fuels, the use of such metal additives is being reduced and higher octane values for such liquid hydrocarbon fuels is obtained by further refining thereof or by the use or organic additives that do not give rise to environmental properties.

SUMMARY OF THE INVENTION

I have found that the octane number of liquid fuel compositions can be increased by the simple expedient of incorporating therein a novel anisole mixture containing anisole and a mixture of selected alkyl anisoles. By "liquid fuel compositions" I mean to include liquid hydrocarbon fuel compositions boiling within the gasoline boiling range for use in spark ignition internal combustion engines. Fuel compositions boiling within the gasoline boiling range include catalytically cracked gasoline, straight run gasoline, reformate, butane and mixtures thereof.

The novel anisole mixture that can be used herein will include anisole itself,

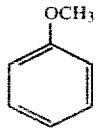

(I)

and a mixture of alkyl anisoles defined by the following formula:

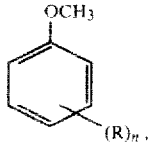

(II)

wherein R is a straight or branched chain alkyl substituent, preferably straight, having from one to four carbon atoms, preferably from one to three carbon atoms, and n is an integer from 1 to 4, preferably from 1 to 3, said mixture of anisoles having a boiling point at atmospheric (ambient) pressure of about 155° to about 230° C., preferably about 155° to about 220° C., the number of individual anisoles in said mixtures of anisoles being about eight to about 30, generally about ten to about 20. In general the weight percent of anisole itself in such anisole mixture will be from about one to about 25 weight percent, generally from about three to about 20 weight percent, with the remainder being substantially the mixtures of alkyl anisoles defined above.

More specifically the novel anisole mixture will include from about one to about 25 weight percent, generally from about three to about 20 weight percent, of anisole itself,

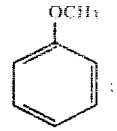

(I)

from about one to about 25 weight percent, generally from about three to about 20 weight percent, of monomethyl anisoles defined by the following formula:

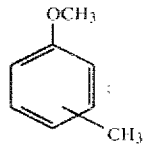

(III)

from about 0.5 to about 20 weight percent, generally from about one to about 15 weight percent, of dimethyl anisoles defined by the following formula:

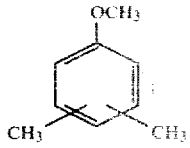

(IV)

from about 0.5 to about 20 weight percent, generally from about one to about 15 weight percent, of trimethyl anisoles defined by the following formula:

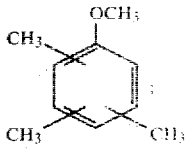

(V)

from about 0.5 to about 20 weight percent, generally from about one to about 15 weight percent of ethyl anisoles defined by the following formula:

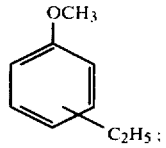

(VI)

from about 0.0 to about five weight percent, generally from about 0.0 to about two weight percent of diethyl anisoles defined by the following formula:

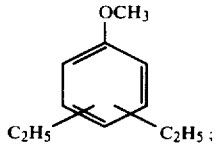

(VII)

from about 0.3 to about 20 weight percent, generally from about 0.5 to about 15 weight percent of propyl (normal propyl or isopropyl) anisoles defined by the following formula:

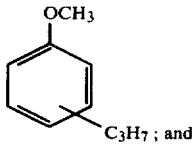

(VIII)

from about 0.0 to about 15 weight percent, generally from about 0.5 to about 10 weight percent, of chloroanisoles defined by the following formula:

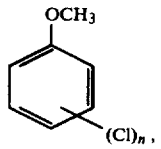

(IX)

wherein n is an integer from 1 to 3, preferably 3.

In the above the alkyl and chloro substituents can be positioned ortho, meta or para relative to the methoxy (—$OCH_3$) group and where two or more alkyl or chloro groups are present they can be positioned ortho, meta or para relative to each other.

The mixture of anisoles used herein are further defined as having a boiling point at atmospheric pressure (ambient pressure) of about 155° to about 230° C., preferably about 155° to about 220° C.

In a particularly preferred embodiment the mixture of anisoles defined above are obtained from phenols present in a selected fraction of coal liquids obtained by treating coal with hydrogen at elevated temperatures and elevated pressures. By "coal liquids" I intend to include, for example, coal liquids obtained by heating a slurry composed of finely-divided coal and a carrier, for example, coal liquids produced in the process, with hydrogen, without a catalyst or with a catalyst, such as cobalt molybdate or nickel titanium molybdate, at a temperature in the range of about 400° to about 510° C., preferably about 370° to about 480° C., and a total pressure of about 500 to about 5000 pounds per square inch gauge (about 3445 to about 34.450 kPa), preferably about 1000 to about 4000 pounds per square inch gauge (about 6890 to about 27560 kPa), for about 0.10 to about two hours, preferably about 0.25 to about 1.5 hours. A process particularly preferred for obtaining coal liquids from which the desired mixture of phenols can be obtained involves passing the feed coal, hydrogen and recycle solvent through a preheater at a temperature of about 315° to about 430° C. and a total pressure of about 1000 to about 4000 pounds per square inch gauge (about 6890 to about 27560 kPa) over a period of about 1.5 to about 30 minutes, introducing the preheated mixture to a dissolver zone, wherein the temperature is maintained in the range of about 370° to about 480° C. and the pressure is maintained in the range of about 1000 to about 4000 pounds per square inch gauge, for about 0.25 to about 1.5 hours, sufficient to dissolve or liquefy at least a portion of the coal, separating from the liquefied coal product hydrocarbon gases, ash (mineral matter originally in the coal), liquefied coal and deashed solid coal, and recycling a portion of the liquefied coal as recycle solvent. In order to improve liquefaction and to increase the ratio of liquefied coal to deashed solid coal, some of the ash obtained can be reyclcled to the dissolver, or hydrocracking, zone. In still another embodiment, hydrogenation of the coal need not be carried out with free hydrogen, but instead the recycle solvent can be hydrogenated prior to introduction into the dissolver. In this way the solvent will become a hydrogen donor and will supply the hydrogen necessary for hydrocracking and desired liquefaction. Examples of processes suitable for obtaining coal liquids can be found in U.S. Pat. Nos. 4,159,238 to Schmid, 3,341,447 to Bull et al, 3,884,795 to Wright et al, 4,110,192 to Hildebrand et al, 3,957,619 to Chun et al, 3,997,426 to Montagna et al, 4,082,282 to Cronauer et al, 4,081,361 to Hildebrand et al, 4,116,808 to Cronauer et al and 4,190,518 to Giannetti et al.

As pointed out above, the mixture of phenols is obtained from a selected fraction of coal liquids, that is, the fraction boiling, at atmospheric pressure, at a temperature in the range of about 55° to about 250° C. This fraction can be obtained from the coal liquids, for example, by simple distillation at atmospheric pressure.

The recovery of the desired phenolic mixture from the above coal liquid fraction can be effected in any desired manner, for example, by solvent extraction or caustic extraction. Thus, the coal liquid fraction can be treated with at least one molar equivalent, preferably from about 1.1 to about 1.5 molar equivalents, relative to the phenols, of an aqueous caustic (sodium hydroxide) solution having a concentration of about five to about 80 percent, preferably about 10 to about 30 percent, with stirring for about one minute to about four hours, preferably about 30 minutes to about one hour, at atmospheric temperature, and atmospheric pressure. The mixture will then separate into an upper neutral hydrocarbon layer and a lower aqueous caustic layer containing the sodium phenolic salts. The two layers are separated from each other, for example, by decantation. The desired phenolic mixture can then be recovered from the lower layer, for example, by contacting the same with at least the molar equivalent of a mineral acid, such as hydrochloric or sulfuric acid, or a carboxylic acid, such as acetic acid or carbonic acid at atmospheric temperature and atmospheric pressure. The resulting mixture will comprise an upper phenolic layer and a lower aqueous layer, which can be separated from each other in any suitable manner, for example, by decantation.

The separated upper layer defined above containing the free phenols previously defined can be converted to the corresponding anisoles in any suitable or convenient manner. This can be done, for example, using standard chemical techniques. Thus, an aqueous solution of the sodium salts of the phenolic mixture can be contacted, while stirring, with at least the molar equivalent, preferably about 1.05 to about 2.0 molar equivalents, of dimethyl sulfate or methyl chloride at atmospheric temperature and atmospheric pressure. If any excess dimethyl sulfate is present, it can be destroyed by reaction with caustic. The upper anisole layer can then be recovered from the lower aqueous layer, for example, by decantation. When methyl chloride is used, the resulting bottom layer is separated by decantation, leaving behind the top anisole layer. Methyl chloride, if present in the top layer, can be removed therefrom by simple distillation. Left behind will be the novel anisole mixture claimed herein. Reference to other procedures for preparing anisoles can be obtained from Encyclopedia of Chemical Technology, Second Edition, Volume 15, Interscience Publishers, New York City, N.Y. (1968), pages 165 and 166, particularly by treating the mixture of phenols with methanol over catalysts, such as alumina and silica, following the procedure of British Patents Nos. 600,837 and 600,835.

The novel liquid fuel compositions claimed herein are simply obtained by mixing the initial liquid fuel compositions and the defined novel anisole mixture. The two components can be blended together in any suitable proportions, but, in general the final composition will contain from about one to about 25 weight percent of the novel anisole mixture, preferably from about three to about 15 weight percent of the noval anisole mixture, with the rest being wholly, or substantially, the initial liquid fuel composition. If desired, other additives normally incorporated in liquid fuel compositions for other purposes, such as rust inhibitors, oxidation inhibitors, anti-icers, detergents, etc., in the amount of about 0.5 to about 500 pounds per thousand barrels, based on the initial liquid fuel composition, can also be employed herein.

DESCRIPTION OF PREFERRED EMBODIMENTS

Tables I and II below show the phenols present in coal liquids obtained from the hydrogenation of coal wherein the hydrogenation was carried out at temperatures in the range of about 360° to about 438° C. and at hydrogen partial pressures of about 1000 to about 4000 pounds per square inch gauge (about 6890 to about 27560 kPa) in the presence of ash previously separated from the liquid coal hydrogenation product. In Table I phenols were obtained from a cut boiling in the range of about 55° to about 249° C. at atmospheric pressure of coal liquids obtained from the hydrogenation of Eastern Bituminous Coals. In Table II the coal used was identified as Ireland Mine Coal, Pitt Seam No. 8, West Virginia, and the cut employed had a boiling point range at atmospheric pressure of about 55° to about 249° C.

TABLE I

| Phenolic Compound | Weight Percent of Cut |
|---|---|
| Phenol | 5.58 |
| Ortho-Cresol | 2.31 |
| Meta-Cresol | 3.65 |
| Para-Cresol | 2.30 |
| 2,4-Dimethylphenol | 0.77 |
| 2,5-Dimethylphenol | 0.38 |

TABLE I-continued

| Phenolic Compound | Weight Percent of Cut |
|---|---|
| 2,6-Dimethylphenol | 0.20 |
| 3,4-Dimethylphenol | 0.12 |
| 3,5-Dimethylphenol | 0.82 |
| Ortho-Ethylphenol | 0.32 |
| Para-Ethylphenol | 0.91 |
| 2-Isopropylphenol | 1.86 |
| Unidentified Phenols | 5.48 |

TABLE II

| Phenolic Compound | Weight Percent of Cut |
|---|---|
| Phenol | 4.70 |
| Meta- and Para-Cresols | 6.06 |
| Ortho-Cresol | 1.40 |
| 3,4-Dimethylphenol | 0.30 |
| 3,5-Dimethylphenol | |
| 2,3-Dimethylphenol | 1.30 |
| 2,5-Dimethylphenol | |
| 2,4-Dimethylphenol | 3.60 |
| 3-Ethylphenol | |
| 4-Ethylphenol | |
| 2-Ethylphenol | 0.50 |
| 1-Naphthol | 0.01 |
| 2,3,5-Trimethylphenol | |
| 2,3,6-Trimethylphenol | 0.02 |
| 2,4-Dichlorophenol | |
| 2,4,6-Trimethylphenol | 0.94 |
| 4-Isopropylphenol | |
| 2-Isopropylphenol | 1.07 |
| Para-Phenylphenol | 0.01 |
| Para-Tertiarybutylphenol | 0.17 |
| 2,4,6-Trichlorophenol | 0.20 |
| 2,4,5-Trichlorophenol | 0.57 |

The mixture of anisoles employed herein was obtained as follows. A composite of raw coal liquid from fifty-one coal liquefaction runs on Eastern bituminous coals carried out at temperatures in the range of about 360° to about 438° C. and at hydrogen pressures of about 1000 to about 4000 pounds per square inch gauge (about 6890 to about 27560 kPa) in the presence of ash previously separated from the liquid coal hydrogenation product was used as the phenol source. The fraction of the composite used was that boiling in the range of 55° to 260° C. This composite fraction, amounting to 7574 pounds (344 kilograms), was divided into two portions and each portion was extracted with 356 pounds (162 kilograms) of 20 percent aqueous sodium hydroxide at 35° C. with stirring over a period of six hours. The lower aqueous layer, having a pH of 10, containing the sodium salts of the phenols was separated from the top neutral layer. The lower basic aqueous layers from the two extractions were combined and washed by stirring with 1185 pounds (538 kilograms) of diethyl ether for six hours at 20° C. to remove non-phenolic organic compounds therefrom. The top either layer was separated and discarded. The lower aqueous layer was checked for non-phenolic, neutral hydrocarbons by a small-scale extraction of an aliquot with ether and found to contain insignificant amounts. The basic, aqueous layer was then stripped of residual ether to a pot temperature of 55° C. with stirring.

The basic, aqueous layer (still containing the sodium salts of the phenols) was then acidified with aqueous 20 percent hydrochloric acid to a pH of 2 with stirring and cooling to maintain a temperature of 20° C. in the reactor, thus converting the sodium salts of the phenols to free phenols. Sodium chloride, in an amount of 500 pounds (230 kilograms), was added to decrease the solubility of the free phenols in the water. After two hours to allow complete phase separation into a lower aqueous phase and an upper phenols phase, the lower aqueous layer was checked by gas chromatography for phenols, but none was found. The lower aqueous layer was then discarded. The remaining phenolic layer was washed twice with a mixture of 415 pounds of water (188 kilograms), 100 pounds of sodium carbonate (45 kilograms) and 50 pounds of sodium chloride (23 kilograms). The lower wash layer was discarded after it was found by gas chromatography to be free of phenols. The mixture of phenols obtained are believed to be similar to those identified in Table I above.

At this point there was found 2180 pounds (990 kilograms) of phenolics. Of this 1850 pounds (840 kilograms) of the phenolic mixture was used in the conversion to the corresponding anisole mixture, hereinafter referred to as "AM". To the phenolic mixture there was added 1200 pounds (545 kilograms) of 50 percent aqueous sodium hydroxide and 1200 pounds (543 kilograms) of water, sufficient to give a 25 weight percent aqueous sodium hydroxide solution. The reaction mixture was stirred with cooling (18° C.) for eight hours and then 2200 pounds (1000 kilograms) of dimethyl sulfate was added thereto with stirring over a period of 10 hours while maintaining the temperature below 34° C. The reaction mixture was then stirred at 20° C. for 36 hours. To the reaction mixture there was then added 127 pounds (58 kilograms) of aqueous 50 percent sodium hydroxide to destroy excess dimethyl sulfate and to remove any unetherified phenols from the crude AM product. The mixture was stirred one hour, allowed to separate into two layers and the lower, aqueous basic phase was discarded. The remaining AM product layer was washed with a mixture of 415 pounds (188 kilograms) of water, 159 pounds (72 kilograms) of 50 percent aqueous sodium hydroxide and 25 pounds (11 kilograms) of sodium chloride. The lower, aqueous wash layer was discarded to give 1801 pounds (820 kilograms) of AM. The crude AM was distilled to give 65 pounds (30 kilograms) of non-AM-containing first cut (boiling point 44° to 69° C. at 58 to 100 mm. Hg), 1440 pounds (660 kilograms) of AM (boiling point 73° to 117° C. at 30 to 50 mm Hg) and 99 pounds (45 kilograms) of a heavy, dark residue. The AM so obtained is characterized below in Table III.

TABLE III

| Inspection: | |
|---|---|
| Density, 20° C., D 941, g/ml | 0.9807 |
| Carbon, Weight Percent | 79.60 |
| Hydrogen, Weight Percent | 8.61 |
| Nitrogen, Weight Percent | 0.15 |
| Oxygen, Weight Percent | 12.39 |
| Distillation, D86, 760 mm | |
| Over: °C. | 140 |
| End: °C. | 226 |
| 5 Percent at: °C. | 168 |
| 10 Percent | 171 |
| 20 Percent | 173 |
| 30 Percent | 176 |
| 40 Percent | 177 |
| 50 Percent | 180 |
| 60 Percent | 183 |
| 70 Percent | 187 |
| 80 Percent | 193 |
| 90 Percent | 202 |
| Recovery: Percent | 99.5 |
| Residue: Percent | 0.5 |

Samples of the above AM product were also analyzed for nuclear magnetic resonance spectrum, gas chromatography and infrared spectrum. The nuclear magnetic resonance and infrared spectra showed absorptions expected for a mixture of anisoles corresponding to a mixture of phenols as shown in Table I above, but did not show the presence of free, unreacted phenols. Gas chromatography also showed an absence of free phenols in the AM product.

The above AM product was blended at five volume percent with a commercial unleaded gasoline. Typical inspections of the base gasoline and the blend are given below in Table IV.

TABLE IV

| Inspection: | Base A: (Commercial Unleaded Gasoline) | Base A + Five Volume Percent AM |
|---|---|---|
| Gravity, API, D 287 | 58.7 | — |
| Lead in Gasoline, D 3237, G/Gal | <0.005 | — |
| Carbon, Weight Percent | 86.82 | — |
| Hydrogen, Weight Percent | 13.18 | — |
| Gum, Existent, D 381, Mg/100 Ml | 2 | — |
| Oxidation Stability, D 525, Min | >1440 | — |
| Hydrocarbon Analysis, D 1319, Volume Percent | | |
| Aromatics | 26.5 | — |
| Olefins | 13.0 | — |
| Saturates | 60.5 | — |
| Motor Octane Number, D 2700 | 84.1[a] | 84.5[a] |
| Research Octane Number, D 2699 | 93.2[a] | 93.8[a] |
| Vapor Pressure, Reid, D 323: psi | 11.0 | 9.8 |
| Distillation, D 86, 760 mm | | |
| Over: °C. | 28 | 31 |
| End: °C. | 212 | 216 |
| 5 Percent At: °C. | 39 | 41 |
| 10 | 44 | 49 |
| 20 | 58 | 64 |
| 30 | 74 | 81 |
| 40 | 89 | 97 |
| 50 | 104 | 111 |
| 60 | 118 | 126 |
| 70 | 131 | 140 |
| 80 | 147 | 156 |
| 90 | 170 | 172 |
| 95 | 192 | 197 |
| Recovery: Percent | 97.5 | 98.0 |
| Residue: Percent | 1.4 | 1.2 |
| Loss: Percent | 1.1 | 0.8 |

[a]Average of two ratings.

The above AM product was also blended at five volume percent with another commercial unleaded gasoline. Typical inspections of the base gasoline and the blend are given below in Table V.

TABLE V

| Inspection: | Base B: (Commercial Unleaded Gasoline) | Base B + Five Volume Percent AM |
|---|---|---|
| Gravity, D 287: °API | 56.8 | 53.7 |
| Alkalinity: pH | 5.0 | 5.0 |
| Viscosity, D 445, 25° C.: cs | 0.56 | 0.57 |
| Vapor Pressure, Reid, D 323: psi | 10.6 (10.1)[a] | 9.9 |
| Vapor Pressure, D 2551: psi | 10.60 | 10.10 |
| Oxidation Stability, D 525: min | 1440 | 1440 |
| 66° C. (150° F.) Gum Time: mg/100 ml | | |
| 1 day interval unwashed | 2 (2) | 2 |
| 1 day interval washed | 2 (1) | 1 |

TABLE V-continued

| Inspection: | Base B: (Commercial Unleaded Gasoline) | Base B + Five Volume Percent AM |
|---|---|---|
| 3 day interval unwashed | 3 (3) | 2 |
| 3 day interval washed | 2 (1) | 1 |
| 6 day interval unwashed | 6 (4) | 3 |
| 6 day interval washed | 6 (2) | 2 |
| Gum, D-381, as received unwashed | 2 (2) | 1 |
| Gum, D-381, as received washed | 1 (1) | 1 |
| Existent Gum, D-381: mg/100 ml | 1 (1) | 1 |
| Copper Dish Gum, D-910: mg/100 ml | 10 (4) | 11 |
| Copper Strip, 50° C. (122° F.), D 130: 3 hr | 1 | 1 |
| Potential Gum, D-873: mg/100 ml | 9 (5) | 4 |
| Distillation, D 86: 760 mm | | |
| Over: °C. | 26 | 25 |
| End: °C. | 211 | 211 |
| 5 Percent at: °C. | 40 | 41 |
| 10 | 50 | 51 |
| 20 | 66 | 70 |
| 30 | 83 | 88 |
| 40 | 100 | 105 |
| 50 | 116 | 120 |
| 60 | 129 | 134 |
| 70 | 141 | 145 |
| 80 | 152 | 155 |
| 90 | 171 | 174 |
| 95 | 192 | 191 |
| Recovery: Percent | 97.9 | 97.9 |
| Residue: Percent | 1.1 | 1.1 |
| Loss: Percent | 1.0 | 1.0 |

[a]Numbers in parentheses are duplicate runs.

Looking at Tables IV and V together, it can be seen that AM is compatible with gasoline. It does not affect significantly the gasoline's specific gravity, distillation curve, alkalinity, viscosity, Reid vapor pressure, oxidation stability, existent gum value, copper dish gum value, copper strip test, or potential gum value. In addition, AM does not separate from gasoline at low temperatures or because of water contamination.

To test the effects of five percent AM in gasoline on plastics and elastomers commonly found in automotive gasoline distribution systems, samples of plastics and elastomers were immersed in Table V base gasoline and in Table V base gasoline containing 5 volume percent AM for five weeks at room temperature. Materials tested were Neoprene, Urethane, Adiprene, Nylon, and Nitrile rubber. Nylon was unaffected by the presence of AM in the gasoline. The other materials swelled somewhat more in the AM/gasoline blend than in the base gasoline but probably little more than would be caused by addition of toluene to the base gaoline. None cracked, hardened, or otherwise deteriorated.

Samples of Table V base gasoline and the Table V base gasoline containing five volume percent AM were studied for mammalian toxicity studies by acute oral toxicity in albino rats, acute dermal toxicity in albino rabbits, and acute vapor inhalation toxicity in rats. Both test samples were found to be relatively harmless to the rat by acute oral exposure and to be practically nontoxic to the rabbit by acute dermal exposure. In the acute vapor inhalation study in rats, body weight gains were within normal limits and necropsy did not reveal any gross pathological alterations. By these tests, the mammalian toxicity of the base gasoline and the base gasoline containing five percent AM was essentially the same.

Microbial contamination of fuels can be a serious problem. To determine whether or not AM in gasoline would increase the incidence of microbial contamination of the gasoline, cultures were prepared in sterile, cotton-stoppered dilution bottles. The aqueous phase consisted of Bushnell-Haas mineral salts medium innoculated with a known number of bacterial cells cultured from contaminated water bottoms from a commercial, unleaded gasoline storage tank. The medium was aseptically dispensed into the bottles in 40, 20, and 4 ml amounts to give (in total culture volumes of 80 ml) aqueous concentrations of 50 percent, 25 percent, and five percent, respectively.

In addition to the five percent AM/base gasoline (Table V), the base gasoline itself and the base basoline containing a commercially-available fuel-soluble microbicide at the recommended concentration of 270 ppm was also tested. The gasoline formulations were layered over the inoculated medium in the dilution bottles to give a final volume of 80 ml. Cultures were incubated at room temperature in a fume hood. To more closely approximate gasoline storage tank conditions, the samples were not shaken. At intervals of 4, 11, and 18 days, a representative aliquot of the aqueous phase of each culture was aseptically taken, serially diluted, and plated to nutrient agar to ascertain the number of viable bacteria. In each case the bacteria were able to grow in cultures containing 25 percent and 50 percent water. When water in the culture medium was reduced to five percent, growth was inhibited in the culture containing 5 percent AM/gasoline blend and in the culture containing gasoline and the fuel-soluble, commercial microbicide. Bacterial growth was not inhibited in the five percent aqueous culture by base gasoline alone. The AM inhibited growth of the inoculum in the five percent aqueous culture to approximately the same extent as the commercial microbicide. While microbistatic, neither material was microbicidal under these test conditions. Since gasoline storage tanks normally contain less than five percent water, the presence of five percent AM in gasoline will help control bacterial contamination.

Since it is known that anisole itself possesses no appreciable mammalian toxicity (*Industrial Hygiene and Toxicology*, 2nd Revised Edition, Frank A. Patty, Editor, Volume 2, Toxicology, pages 1680, 1681 and 1682), it was not too surprising that the novel AM mixture herein similarly possessed no appreciable mammalian toxicity. It is also known that anisole is practically without effect on bacterial metabolism (P. Fritsch, et al, *European Journal of Toxicology and Environmental Hygiene*, volume 8, number 3, 1975, pages 169–174). I expected, therefore, that the novel AM mixture would possess no effective microbistatic properties. It was surprising, then, to find in the above test that the novel AM mixture defined and claimed herein possessed desirable microbistatic properties.

A comparison was made of the research octane and motor octane values for the Table IV base gasoline and the Table IV base gasoline containing five, ten and 15 volume percent AM. Based on averaging of duplicate measurements, five percent AM increases octane of 93 RON, 84 MON base gasoline by 0.6 RON and 0.4 MON. At ten percent, AM increases octane by 2.2 RON and 0.9 MON. At 15 percent, AM increases octane of the base gasoline by 3.1 RON and 1.3 MON. This is shown below in Table VI.

TABLE VI

| Gasoline | RON[a] (D 2699) | MON[a] (D 2700) | RON + MON / 2 |
|---|---|---|---|
| Base | 93.2 | 84.1 | 88.6 |
| Base + Five Volume Percent AM | 93.8 | 84.5 | 89.1 |
| Base + Ten Volume Percent AM | 95.4 | 85.0 | 90.2 |
| Base + 15 Volume Percent AM | 96.3 | 85.4 | 90.8 |

[a]Average of two ratings.

Using an average RON and MON value, it can be seen from the above that when the gasoline contained 15 volume percent of the novel AM mixture herein, an increase in octane value of almost 2.5 percent was achieved.

I have found, in addition, that the novel anisole mixture defined and claimed herein produces an increase in the octane number of the gasoline containing the same in excess of the amount that would be expected based on the increase obtained using the same amount of anisole in gasoline. Thus, a series of runs similar to those of Table VI were carried out wherein the gasoline tested in one contained ten volume percent of anisole and in another contained ten volume percent of the same AM employed above. The results are tabulated below in Table VII.

TABLE VII

| Gasoline | MON[a] (D 2699) | RON[a] (D 2700) | RON + MON / 2 | Average Increase |
|---|---|---|---|---|
| Base | 83.60 | 93.50 | 88.55 | — |
| Base + Ten Volume Percent Anisole | 84.70 | 95.15 | 89.92 | 1.37 |
| Base | 83.10 | 93.15 | 88.12 | — |
| Base + Ten Volume Percent AM | 83.95 | 95.40 | 89.67 | 1.55 |

From the above it can be seen that whereas anisole alone improved the octane number of the gasoline by 1.37 units, the novel AM mixture herein improved the octane rating by 1.55 units, about 13 percent more. This is unexpected in view of the prior art. For example, in European Patent Application Ser. No. 79302082.7 of Roman et al published Apr. 16, 1980, in Table I thereof, it is shown that whether cumylmethyl ether alone, methyltertiarylbutyl ether alone, anisole alone or mixtures of cumylmethyl ether and methyltertiarybutyl ether are incorporated in gasoline, the octane improvement would be about the same in each instance. It was a surprise, therefore, to find that the specific novel anisole mixture herein gave rise to improvements in octane value in excess of anisole itself.

The above clearly shows that mixtures of alkyl anisoles obtained from mixtures of phenols present in selected fractions of hydrocarbon liquids derived from the hydrogenation of coal are excellent non-metallic gasoline blending agents and octane improvers possessing unexpected microbistatic properties.

Obviously, many modifications and variations of the invention, as hereinabove set forth, can be made without departing from the spirit and scope thereof, and therefore only such limitations should be imposed as are indicated in the appended claims.

We claim:

1. A novel anisole mixture containing anisole and a mixture of alkyl anisoles defined by the following formula:

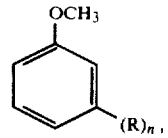

wherein R is a straight or branched chain alkyl substituent having from one to four carbon atoms and n is an integer from 1 to 4, said novel mixture of anisoles having a boiling point of about 155° to about 230° C., wherein the number of individual anisoles in the novel anisole mixture ranges from about eight to about 30.

2. The novel anisole mixture of claim 1 wherein R is a straight chain alkyl substituent.

3. The novel anisole mixture of claim 1 wherein R has from one to three carbon atoms.

4. The novel anisole mixture of claim 1 wherein said novel mixture of anisoles has a boiling point in the range of about 155° to about 220° C.

5. The novel anisole mixture of claim 1 wherein the number of individual anisoles therein ranges from about ten to about 20.

6. The novel anisole mixture of claim 1 wherein the weight percent of anisole therein is in the range of about one to about 25 weight percent.

7. The novel anisole mixture of claim 1 wherein the weight percent of anisole therein is in the range of about three to about 20 weight percent.

8. The novel anisole mixture of claim 1 wherein said mixture of alkyl anisoles includes monomethyl anisoles, dimethyl anisoles, trimethyl anisoles, ethyl anisole and propyl anisoles.

9. The novel anisole mixture of claim 8 wherein the weight percent of the monomethyl anisoles is about one to about 25 percent, dimethyl anisoles from about 0.5 to about 20 percent, trimethyl anisoles from about 0.5 to about 20 percent, ethyl anisoles from about 0.5 to about 20 percent, and propyl anisoles from about 0.3 to about 20 percent.

10. The novel anisole mixture of claim 8 wherein the weight percent of the monomethyl anisoles is about three to about 20 percent, dimethyl anisoles from about one to about 15 percent, trimethyl anisoles from about one to about 15 percent, ethyl anisoles from about one to about 15 percent, and propyl anisoles from about 0.5 to about 15 percent.

11. A liquid hydrocarbon fuel composition containing a liquid hydrocarbon fuel composition and a novel anisole mixture containing anisole and a mixture of alkyl anisoles defined by the following formula:

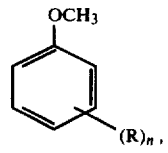

wherein R is a straight or branched chain alkyl substituent having from one to four carbon atoms and n is an integer from 1 to 4, said novel mixture of anisoles having a boiling point of about 155° to about 230° C., wherein the number of individual anisoles in the novel anisole mixture ranges from about eight to about 30.

12. The liquid fuel composition of claim 11 wherein R in the novel anisole mixture is a straight chain alkyl substituent.

13. The liquid fuel composition of claim 11 wherein R in the novel anisole mixture has from one to three carbon atoms.

14. The liquid fuel composition of claim 11 wherein said novel mixture of anisoles has a boiling point in the range of about 155° to about 220° C.

15. The liquid fuel composition of claim 11 wherein the number of individual anisoles in the novel anisole mixture ranges from about ten to about 20.

16. The liquid fuel composition of claim 11 wherein the weight percent of anisole in the novel anisole mixture is in the range of about one to about 25 weight percent.

17. The liquid fuel composition of claim 11 wherein the weight percent of anisole in the novel anisole mixture is in the range of about three to about 20 weight percent.

18. The liquid fuel composition of claim 11 wherein the novel anisole mixture of alkyl anisoles includes monomethyl anisoles, dimethyl anisoles, trimethyl anisoles, ethyl anisole and propyl anisoles.

19. The liquid fuel composition of claim 18 wherein the weight percent of the monomethyl anisoles is about one to about 25 percent, dimethyl anisoles from about 0.5 to about 20 percent, trimethyl anisoles from about 0.5 to about 20 percent, ethyl anisoles from about 0.5 to about 20 percent, and propyl anisoles from about 0.3 to about 20 percent.

20. The liquid fuel composition of claim 18 wherein the weight percent of the monomethyl anisoles is about three to about 20 percent, dimethyl anisoles from about one to about 15 percent, trimethyl anisoles from about one to about 15 percent, ethyl anisoles from about one to about 15 percent, and propyl anisoles from about 0.5 to about 15 percent.

21. The liquid fuel composition of claim 11 wherein the amount of said novel anisole mixture therein is in the range of about one to about 25 weight percent.

22. The liquid fuel composition of claim 11 wherein the amount of said novel anisole mixture therein is in the range of about three to about 15 weight percent.

23. The liquid fuel composition of claim 11 wherein said liquid hydrocarbon fuel composition boils within the gasoline boiling range.

24. The liquid fuel composition of claim 11 wherein said liquid hydrocarbon fuel composition is gasoline.

* * * * *